US010487784B2

(12) United States Patent
Kügerl et al.

(10) Patent No.: US 10,487,784 B2
(45) Date of Patent: Nov. 26, 2019

(54) DEVICE AND METHOD FOR IMPROVING COMBUSTION

(71) Applicants: EPCOS AG, Munich (DE); Relyon Plasma GmbH, Regensburg (DE)

(72) Inventors: Georg Kügerl, Eibiswald (AT); Markus Puff, Graz (AT); Christoph Auer, Graz (AT); Stefan Nettesheim, Regensburg (DE)

(73) Assignees: EPCOS AG, Munich (DE); RELYON PLASMA GMBH, Regensburg (DE)

( * ) Notice: Subject to any disclaimer, the term of this patent is extended or adjusted under 35 U.S.C. 154(b) by 55 days.

(21) Appl. No.: 15/532,989

(22) PCT Filed: Dec. 2, 2015

(86) PCT No.: PCT/EP2015/078411
§ 371 (c)(1),
(2) Date: Jun. 2, 2017

(87) PCT Pub. No.: WO2016/087547
PCT Pub. Date: Jun. 9, 2016

(65) Prior Publication Data

US 2017/0328314 A1 Nov. 16, 2017

(30) Foreign Application Priority Data

Dec. 3, 2014 (DE) ..... 10 2014 117 799

(51) Int. Cl.
*F02M 27/04* (2006.01)
*F23K 5/08* (2006.01)
*H05H 1/24* (2006.01)

(52) U.S. Cl.
CPC ..... *F02M 27/042* (2013.01); *F23K 5/08* (2013.01); *H05H 1/2475* (2013.01); *F23C 2900/99005* (2013.01); *H05H 2001/2481* (2013.01)

(58) Field of Classification Search
CPC ..... F02M 27/042; F02M 27/07; F02M 27/00; F23K 5/08
See application file for complete search history.

(56) References Cited

U.S. PATENT DOCUMENTS 5,640,020 A 6/1997 Murakoshi et al.
6,221,271 B1 4/2001 Watanabe et al.
(Continued)

FOREIGN PATENT DOCUMENTS

CN 201401251 Y 2/2010
DE 10358294 A1 8/2004
(Continued)

OTHER PUBLICATIONS

"CeraPlas™ Piezo Plasma Generator." TSK Electronics, TSK , Oct. 31, 2014, www.tdk-electronics.tdk.com/en/373562/tech-library/articles/applications---cases/applications---cases/cold-plasma-from-a-single-component/1109546.*
(Continued)

*Primary Examiner* — Kevin A Lathers
(74) *Attorney, Agent, or Firm* — Slater Matsil, LLP

(57) ABSTRACT

A device and a method for improving combustion are disclosed. In an embodiment the device includes a combustion chamber including at least one combustion chamber inlet for feeding in fuel or air or the fuel/air mixture, a reactor chamber connected upstream of the combustion chamber, the reactor chamber comprising a plasma generator, wherein the plasma generator is a piezoelectric transformer configured to operate with a low voltage and a
(Continued)

control apparatus for the plasma generator, wherein the device is configured in such a way that even before a start of an actual combustion process at least one gaseous component in the reactor chamber is enriched with radicals and ions by the plasma generator.

12 Claims, 2 Drawing Sheets

(56) References Cited

U.S. PATENT DOCUMENTS

| | | | | |
|---|---|---|---|---|
| 8,466,730 | B2 | 6/2013 | Terazawa | |
| 8,466,763 | B2 | 6/2013 | Terazawa | |
| 8,807,463 | B1 * | 8/2014 | McAlister | F02M 51/066 239/584 |
| 2004/0159289 | A1 | 8/2004 | Taylor, III et al. | |
| 2006/0137642 | A1 | 6/2006 | Artmann et al. | |
| 2007/0012300 | A1 | 1/2007 | Clack | |
| 2009/0122941 | A1 | 5/2009 | Engemann et al. | |
| 2015/0373824 | A1 | 12/2015 | Nettesheim et al. | |
| 2015/0377205 | A1 * | 12/2015 | Idicheria | F02F 1/24 123/294 |

FOREIGN PATENT DOCUMENTS

| | | | |
|---|---|---|---|
| DE | 10331418 | A1 | 1/2005 |
| DE | 102013100617 | A9 | 10/2014 |
| EP | 1845251 | A1 | 10/2007 |
| EP | 2256835 | A2 | 12/2010 |
| GB | 2353069 | A | 2/2001 |
| JP | S58053139 | A | 3/1983 |
| JP | 5893952 | A | 6/1983 |
| JP | H08200190 | A | 8/1996 |
| JP | H09147771 | A | 6/1997 |
| JP | H09181372 | A | 7/1997 |
| JP | H11274595 | A | 10/1999 |
| JP | 2004147454 | A | 5/2004 |
| JP | 2005069223 | A | 3/2005 |
| JP | 2006250271 | A | 9/2006 |
| JP | 2007107491 | A | 4/2007 |
| JP | 2009501409 | A | 1/2009 |
| JP | 2012154194 | A | 8/2012 |
| JP | 2013072415 | A | 4/2013 |
| WO | 2012127896 | A1 | 9/2012 |
| WO | 2014115050 | A | 7/2014 |

OTHER PUBLICATIONS

T-Online: "Will the Spark Plug Soon be Replaced?", http://www.t-online.de/auto/technik/id_60835608/das-ende-der-zuendkerze-corona-zuendung-soll-sprit-sparen.html; Nov. 9, 2012, pp. 3.

* cited by examiner

DEVICE AND METHOD FOR IMPROVING COMBUSTION

This patent application is a national phase filing under section 371 of PCT/EP2015/078411, filed Dec. 2, 2015, which claims the priority of German patent application 10 2014 117 799.1, filed Dec. 3, 2014, each of which is incorporated herein by reference in its entirety.

TECHNICAL FIELD

The invention relates to a device for improved combustion of a fuel/air mixture in a combustion chamber, and to a method for improved combustion.

BACKGROUND

In combustion engines such as, e.g., spark ignition engines and diesel engines for motor vehicles, a mixture of fuel and ambient air is introduced into a combustion chamber, mixed and ignited under controlled conditions and made to burn. This combustion generally occurs incompletely and only approximately 99% of all the components of the mixture are burnt to form water and carbon dioxide. The remaining portion is composed of $NO_x$, CO, soot, tar and hydrocarbons.

In all combustion engines with internal combustion, the gas which is involved changes after each working cycle, that is to say exhaust gas is ejected and fresh gas is fed in. Contemporary motors compress the gas, then the gas is burnt at a high pressure and relaxed again. The maximum possible efficiency depends on the temperature levels at which the combustion heat is fed in and carried away, and therefore on the compression ratio. Incomplete combustion reduces the efficiency further. This also applies to other technical apparatuses with combustion chambers, e.g., to boilers.

Liquid fuels which are based on crude oil contain a large number of different hydrocarbons (hydrogen and bound carbons). In order to convert these fuels into energy, combustion must take place. The result of complete combustion is water and carbon dioxide. If the combustion is not complete, carbon monoxide, soot and tar are produced.

Small and lightweight hydrocarbon molecules such as, e.g., those in gases or petroleum burn easily. In contrast, large and heavy hydrocarbon molecules do not burn as easily and require a relatively high temperature in order to achieve complete combustion. During the combustion process, the speed of the combustion is influenced by the quantity and the concentration of free radicals which are present and are produced by the combustion. These free radicals are generated inter alia by splitting of the hydrocarbon molecules at a relatively high temperature. As result of their high reactivity they react immediately with oxygen. During this oxidation heat is released, which gives rise to further thermal splitting.

If the ignition of the fuel mixture in the combustion chamber of a combustion engine lasts for a relatively long time, the center of combustion also shifts. In addition, a relatively long spark length when there is a relatively consumption of energy can accelerate the wear on the spark plug. An increased concentration of free radicals brings about a more intensive and faster combustion process.

DE 10331418 A9 proposes using a plasma, instead of a spark plug, in order to improve the combustion, and generating of said plasma within the combustion chamber. However, it is problematic to integrate the plasma generator into the combustion chamber and adapt it to the conditions prevailing there.

EP 1845251 A1 discloses a generator with a combustion chamber. A plasma generator or ion generator connected to a high-voltage source generates ions and feeds them into the device at a location which is connected upstream of the combustion chamber, in order to improve the efficiency of the combustion.

JP S58-93952 A discloses a method for improving the efficiency of a combustion engine in which the combustion is promoted by ionized oxygen.

US 2007/0012300 A1 discloses a combustion engine with improved efficiency, in which the combustion is promoted by means of ozone which is enriched in the inflow of air into the combustion chamber.

DE 10358294 A1 discloses a combustion engine having a fuel reformer which, inter alia, may also be embodied as a plasma fuel reformer.

SUMMARY OF THE INVENTION

Embodiments of the present invention provide an improved device and a method with which as far as possible complete and homogeneous combustion can be achieved without at the same time having to accept the disadvantages of the known solution. Further embodiments utilize the energy content of the fuel mixture to a maximum extent and to avoid noxious waste gases as far as possible.

Embodiments of the invention propose optimizing the combustion of a fuel/air mixture by virtue of the fact that at least one reactor chamber in which at least one component of the fuel/air mixture can be enriched with radicals and ions by means of a plasma generator is connected upstream of the combustion chamber in which the combustion takes place. The combustion chamber itself can then be embodied as in known combustion devices. A piezoelectric transformer which can be operated with a low voltage is used as the plasma generator.

Furthermore, the device comprises a control apparatus by means of which the enrichment of the component of the fuel/air mixture can be regulated.

The inventors have recognized that the correct concentration of free radicals and ions is important for the completeness of the combustion even in an early stage of the combustion process. With the plasma generator provided according to the invention in the reactor chamber, the number of free radicals and ions in the fuel/air mixture can be increased even before the start of the combustion. The combustion can then be triggered more quickly when the fuel/air mixture is ignited, and can then also end earlier. As a result, it also occurs more completely. This is advantageous, in particular, in combustion engines in which the ignition of the fuel/air mixture takes place at a time which is predefined by the working stroke of the combustion engine and for which only a narrow time window is available. The invention makes it easier to carry out the combustion completely within this time window. As result, a larger portion of the fuel can be used as energy and converted than until now.

The piezoelectric transformer which is used as a plasma generator and can be operated with a low voltage can be manufactured in a compact design and operated with the low operating voltages of, for example, 12, 24 or 48 V on the input side, as is customary, for example, in motor vehicles.

With such a plasma generator it is also possible to generate a cold plasma with a temperature of less than 50°

C., which does not excessively load the device and the materials used for it, and therefore does not pose any excessive requirements for the materials of the reactor chamber. Therefore, largely conventional materials can be used for the embodiment of the reactor chamber and of the gas inlet into the combustion chamber.

However, it is advantageous to provide the reactor chamber and the connection between the reactor chamber and the combustion chamber with smooth and, in particular, inert surfaces, or to equip them with an inert and smooth coating. Inert means here that the surface does not enter into any ionic or radical reactions with the plasma which could cause a concentration of radicals and ions in the enriched quantity of gas to be reduced.

Furthermore it is advantageous to arrange the reactor chamber spatially as close as possible to the combustion chamber and to make the connections and feedlines between them as short as possible in order to minimize the dwell time therein of the gaseous component which is enriched with radicals and ions. This avoids a situation in which the concentration of radicals and ions which have only a short half-life period decreases too strongly during the transportation to the combustion chamber. The term "gaseous" is also understood within the sense of the invention here and below to mean mixtures which behave like gases, such as, e.g., also finely distributed liquids (fog).

Piezoelectric transformers (PT) generate strong electrical fields by means of the piezoelectric effect. These fields are capable of ionizing gases and liquids through electrical excitation. On the secondary side of the PT, the electrical alternating field generates strong polarization, excitation and ionization of atoms and molecules. This process generates a piezoelectrically ignited microplasma, PDP (piezoelectric discharge plasma). PDPs have properties which correspond to typical dielectric battery discharges (DBD). PDPs can be ignited in a wide pressure range from 0.01 mbar to 2000 mbar, which is compatible, in particular with different requirements for the combustion.

In the case of piezoelectric transformers, the alternating voltage which is fed in on the primary side is firstly converted into a mechanical oscillation within the piezoelectric body by means of the electrodes which are vapor coated onto a piezoelectric crystal or—in a ceramic design—burnt into the ceramic structure of the transformer. The frequency of the mechanical oscillation is essentially dependent here on the geometry and the mechanical structure.

As result, a mechanical wave is formed within the transformer PT, which wave generates an output voltage on the second-side electrode as result of the piezoelectric effect. The magnitude of the secondary-side output voltage is dependent here, inter alia, on the geometry of the crystal wafer or of the ceramic body and the position of the electrodes.

In order to generate PDP (piezoelectric discharge plasma), piezoelectric transformers of the Rosen type PT are particularly suitable since this type supplies high power-densities and very high transmission ratios. The use of a ceramic multi-layered structure with internal electrodes on the primary side is particularly advantageous since in this way it is possible to use particularly low primary voltages to ignite the plasma. In practice, transformation ratios of more than 1000 can therefore be achieved.

According to the invention, the piezoelectric transformers are advantageously operated at their resonant frequencies. Frequencies between 10 kHz to 500 kHz are optimum for the ignition of PDP.

If the power driver is adapted in an optimum way to the resonance and to the impedance of the PT, the conversion of the mechanical oscillation into the discharge process takes place with a high degree of efficiency. The operating behavior of the system under plasma-generating conditions differs greatly from the electrical small signal behavior of the system. At the threshold at which the discharge ignites, the damping of the PT increases, the power input increases and the resonant frequency shifts. In order to stabilize the PDP it is possible, e.g., to adjust the frequency (frequency tracking).

In one advantageous refinement, the combustion chamber of the device has a gas outlet at which or downstream of which (viewed in the direction of gas flow) a sensor is arranged which is connected to the control apparatus via a feedback loop. The sensor is configured to acquire a value which constitutes a measure for the completeness of the combustion.

Such a sensor is configured, for example, to determine the concentration of unburnt hydrocarbons. A further possibility is to construct the sensor as a lambda probe and to determine the concentration of the oxygen in the exhaust gas derived from the combustion chamber. Both are a measure of the completeness of the combustion in the combustion chamber.

The control apparatus can then be configured to regulate the plasma generator via the feedback loop as a function of the value determined by the sensor, in such a way that the concentration of radicals and ions is set in an optimum way.

In one embodiment, the plasma generator is regulated by a corresponding amount of primary power which is input. This can be carried out, for example, by means of the applied operating voltage the operating current induced thereby.

Alternatively or additionally, the device can comprise a sensor for acquiring the concentration of radicals and ions in the gaseous component or components upstream of the inlet into the combustion chamber, this being, for example, a gas/ion sensor. This sensor can be arranged in front of the gas inlet into the combustion chamber and can also be connected to the control apparatus.

However, this embodiment with just one such sensor requires knowledge of the optimum concentration of radicals and ions which is necessary for the respective combustion conditions. Such a sensor may be appropriate when the quantity of air/fuel mixture which is to be introduced into the combustion chamber varies rapidly and strongly. With such a sensor, the flow speed of the fuel/air mixture which varies as a result can be compensated. In the case of a relatively slow flow speed, there is a relatively long dwell time in the system and therefore an increased decomposition of radicals and ions before the start of the actual combustion, which can be compensated with this regulating process.

According to the invention, only a portion of the fuel/air mixture in the reactor space is enriched with radicals and ions. This portion can be a volume portion. However, it is also possible for just one component of the fuel/air mixture to be enriched with radicals and ions.

In particular in the first-mentioned case, the concentration of radicals and ions in the combustion chamber can be set and regulated in this way by means of the mixture ratio of a first and a second partial flow of the fuel/air mixture. The second partial flow is then not fed via the reactor chamber and is therefore free of plasma components, that is to say free of radicals and ions.

In the case of an unchanged plasma generator power it is thus also possible to set the concentration of radicals and ions in the combustion/air mixture within the combustion chamber.

BRIEF DESCRIPTION OF THE DRAWINGS

In the text which follows, the device and the method carried out therein will be explained in more detail on the basis of exemplary embodiments and the associated figures. The figures serve solely to illustrate and provide better understanding of the invention and are therefore executed only schematically and are not true to scale. Therefore, neither absolute nor relative dimensional data can be extracted from the figures.

In the drawings.

DETAILED DESCRIPTION OF ILLUSTRATIVE EMBODIMENTS

Figure 1:
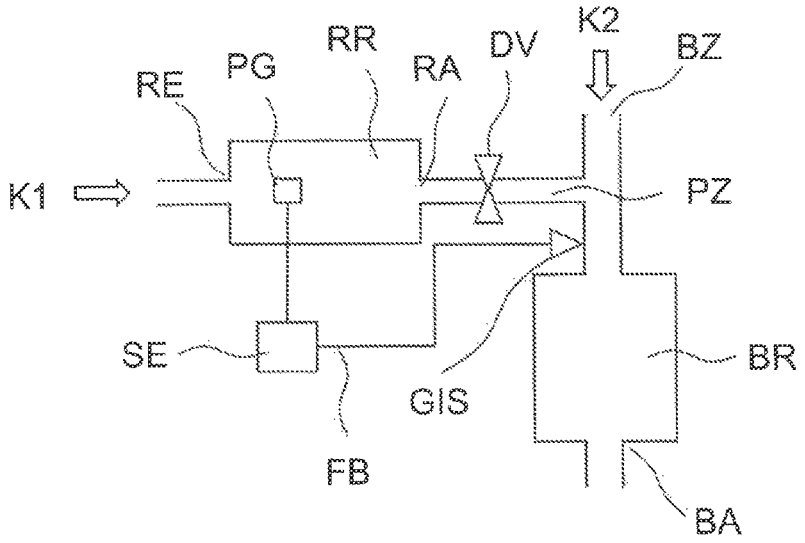
FIG. 1 shows a first embodiment of the device according to the invention in which two partial flows of the fuel/air mixture are fed into the combustion chamber.

FIG. 1 shows a first embodiment of the device according to the invention. The latter is composed of the combustion chamber BR and a reactor chamber RR which is connected upstream thereof. A first component or a first partial flow K1 of the fuel/air mixture is fed into the reactor chamber RR via a reactor chamber inlet RE. A plasma generator PG is arranged there and, under certain circumstances, the introduced gas is made to wash around said plasma generator PG by means of special additional measures. The plasma generator PG converts a portion of the first component into a plasma, or enriches the first component with radicals and ions.

The component/partial flow which is enriched with plasma is conducted out of the reactor chamber RR via a plasma component feedline PZ. In the plasma component feedline PZ a throttle valve DV is arranged by means of which the gas flow can be set and, in particular, reduced.

A second component K2 of the fuel/air mixture or a second partial flow of the fuel/air mixture is fed into the combustion chamber BR via a fuel feedline BZ and a combustion chamber inlet BE. The plasma component feedline PZ opens into the fuel feedline BZ near to the combustion chamber. A gas/ion sensor GIS is also arranged near to the combustion chamber inlet BE. This gas/ion sensor GIS detects, within the fuel feedline BZ, a value which is representative of the plasma portion of the fuel/air mixture. For example, the sensor can determine the degree of ionization of the mixture. It is also possible to determine the ozone content of the mixture, which ozone content also constitutes a typical value for the plasma content of the mixture.

An ion sensor can be embodied, for example, as a conductivity sensor. In this context, the conductivity between two electrodes arranged at a free distance from one another in space or at a predefined distance on a surface can be determined when the plasma-containing mixture is washed around the path to be bridged.

The combustion chamber BR itself is, for example, the combustion chamber of a combustion engine, for example, of a spark ignition engine or diesel engine. However, the combustion chamber BR can also be assigned to a boiler and be a pure thermal generator. At any rate, the fuel/air mixture is ignited within the combustion chamber BR. Owing to the portion of ions and free radicals already present at the start, the ignition of the mixture is facilitated and the combustion occurs more completely.

In a combustion engine, the mixture is additionally compressed and ignited at the desired time, in particular at the degree of maximum compression by means of an ignition source. Continuous ignition takes place in a combustion chamber BR of a thermal generator.

The exhaust gases resulting from the combustion of the mixture are led out of the combustion chamber BR via a combustion chamber outlet BA. In a combustion engine this takes place at the cycle of the engine, while in the case of a thermal generator it usually takes place continuously.

The device also has a feedback loop FB which connects the gas/ion sensor GIS to a control apparatus SE. The control apparatus is in turn connected to the plasma generator PG and regulates its plasma generation, for example, by means of the power made available, in particular by means of a voltage.

A sensor which is arranged at or behind the combustion chamber outlet BA and a feedback loop FB can also be provided. The sensor is configured to acquire a value which constitutes a measure of the completeness of the combustion. Via the feedback loop, this value can be used by the control apparatus to regulate the plasma generator and therefore to improve the combustion power in the combustion chamber.

In one advantageous embodiment, a piezoelectric transformer (see also FIG. 5) is used as a plasma generator PG. Said transformer is embodied, for example, in a rod shape and has on the primary side a multi-layer structure in which piezoelectric ceramic layers and associated electrodes alternate. Different poles of the applied primary voltage can be applied alternately to the electrodes.

A plasma generator which is suitable for the invention is marketed, for example, under the name CeraPLAS™ by the company EPCOS. Said plasma generator is based on a rod-shaped PZT ceramic body (PZT=lead zirconate titanate) with a multi-layer structure and has copper-containing electrodes.

The piezoelectric transformer is a Rosen transformer or Rosen-type transformer, has alternating voltage applied to it and generates a longitudinal oscillation in the rod-shaped ceramic body. A longitudinal wave can then be tapped at the two ends of the rod-shaped ceramic body by means of secondary electrodes mounted there. On the secondary side, voltage transformation conditions up to a factor of 1000 can be set in this way. This means an output voltage in the range of 10 to 15 KV given an input voltage of, for example, 12 V. By suitably configuring the electrodes at the rod end of the secondary side it is possible to ignite or generate a plasma there by discharging.

The plasma itself is generated at an outlet electrode by a process similar to a dielectric battery discharge. However, there is no need for an opposing electrode in the vicinity of the outlet electrode. The outlet electrode is preferably made to extend to the surface at one edge of the ceramic body and can generate the plasma at said surface by means of the high-voltage discharge.

The feedback loop FS serves to regulate the plasma content of the gas content K1, determined shortly in front of the combustion inlet BE, via the feedback loop and the control apparatus SE, preferably by regulating its power, that is to say its plasma generation.

Figure 2:
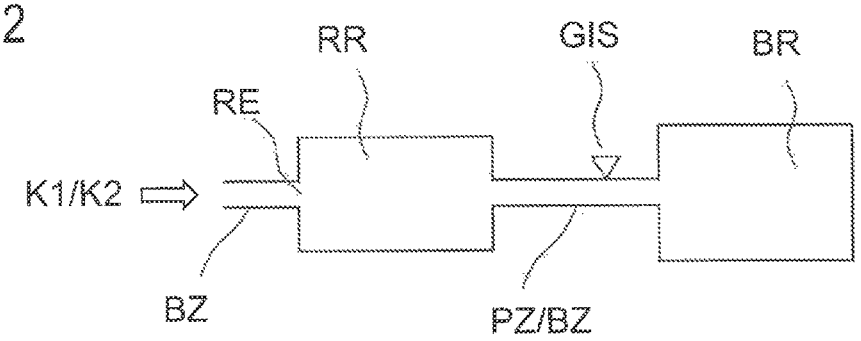
FIG. 2 shows a second embodiment of the device in which the entire the fuel/air mixture is conducted through the reactor with the plasma generator.

FIG. 2 shows a further embodiment of the invention in a schematic cross section. In this embodiment, the entire fuel/air mixture is fed by means of a fuel feedline BZ into the reactor chamber RR and enriched there with free radicals and ions by means of a plasma generator (not represented separately in FIG. 2). The enriched fuel/air mixture is then fed via a combined plasma component feedline/fuel feedline PZ/BZ to the combustion chamber BR. Near to the combustion chamber a gas/ion sensor GIS is again arranged which can detect the plasma content, in particular the content of free radicals and/or ions in the enriched mixture.

The inlet to the combustion chamber BR can be a simple valve or a nozzle. Via a feedback loop FS (not illustrated in this figure), the power of the plasma generator is regulated by means of a control apparatus SE as a function of the optimum value predefined by the measured plasma concentration.

The predefined optimum value can be known or can be made dependent or be dependent on further operating parameters in the combustion chamber BR. In a combustion engine this can be, for example, on the retrieved power or on the quantity of fuel/air mixture fed into the combustion chamber BR per unit of time. In this embodiment, the ratio of the fuel to the air in the mixture is set at a stage upstream of the reactor chamber RR. The plasma excitation therefore takes place in the fuel/air mixture and not only in a component thereof, as in the device according to FIG. 1.

Figure 3:
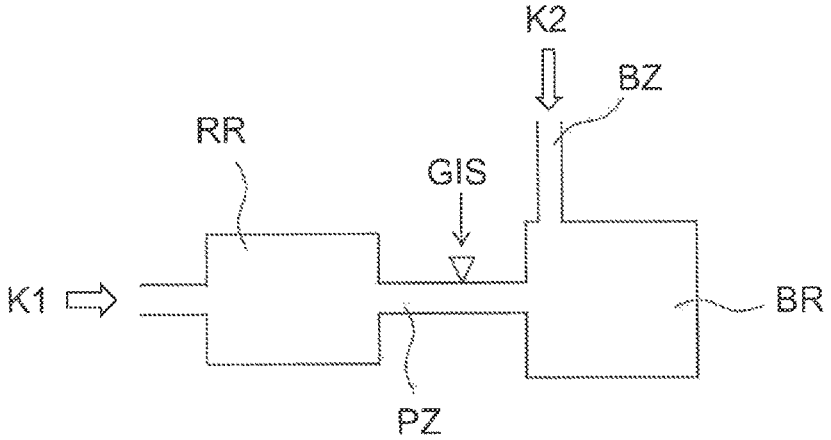
FIG. 3 shows a third embodiment of a device according to the invention in which the portion of air in the fuel/air mixture is fed into the combustion chamber via the reactor chamber, while the fuel is fed, and in particular injected, directly into the combustion chamber.

FIG. 3 shows a third embodiment of the device according to the invention. This is constructed similarly to the device according to FIG. 2, but differs therefrom in that exclusively the air component K1 is enriched with plasma and fed into the reactor chamber RR via the plasma component feedline PZ. The air component which is enriched with plasma is transferred directly into the combustion chamber BR. The fuel component K2 itself is introduced, and in particular injected, separately into the combustion chamber BR via a fuel feedline BZ. The gas/ion sensor GIS in the plasma component feedline PZ is also arranged again near to the inlet to the combustion chamber BR here and connected via a feedback loop to the control apparatus (not illustrated in the figure) and the plasma generator (likewise not illustrated).

This embodiment permits the concentration of ions and radicals prevailing in the combustion chamber BR to be set by means of the portion of the air which is fed into said combustion chamber BR and enriched with plasma. However, it is also possible to set a constant ratio of enriched air to injected fuel or to make this ratio dependent on the operating state of the combustion chamber, consequently on the power of the combustion engine or of the thermal generator.

Figure 4:
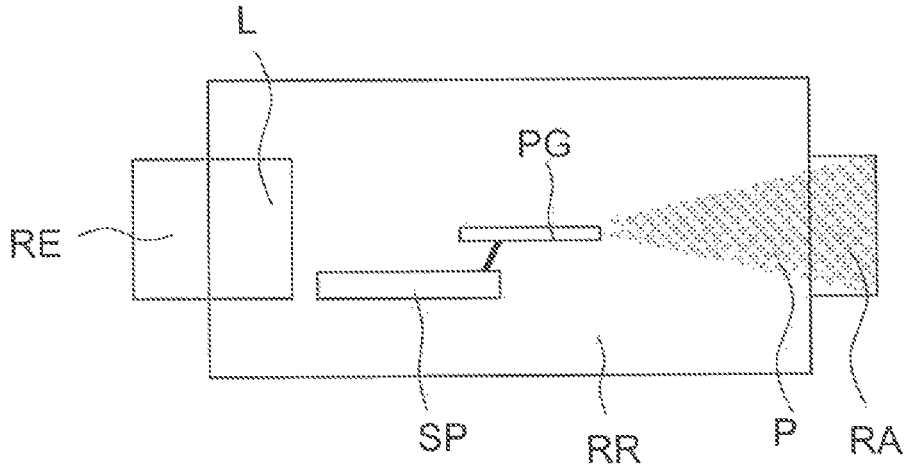
FIG. 4 shows an inventive refinement of the reactor chamber.

FIG. 4 shows a schematic cross section through a reactor chamber such as can be used in the invention to generate a fuel/air mixture enriched with plasma.

The reactor chamber RR is provided with a reactor chamber inlet RE and a reactor chamber outlet RA, which are preferably arranged opposite one another. At least the plasma generator PG, and preferably also an associated electrical actuation unit SP (as illustrated in the figure), are arranged inside the reactor chamber RR.

Owing to the design of the plasma generator PG, which is embodied as a piezoelectric transformer with a dielectric battery discharge on the secondary side, that is to say at the high-voltage end, a plasma cloud develops at the end at which the discharge exits the ceramic body of the transformer.

A fan L, which ensures a movement of air within the reactor chamber RR, is preferably arranged in or directly downstream of the reactor chamber inlet RE so that the generated airstream can wash around the plasma generator PG. If the reactor chamber outlet RA is additionally also opened, an airflow is produced which drives the plasma cloud P in the direction of the reactor chamber outlet RA, with the result that a plasma cloud P which is essentially conical as illustrated is developed at each discharge point. The ventilation is set here in such a way that the gas or the component of the fuel/air mixture or the entire mixture flowing through the reactor chamber RR is enriched homogeneously with radicals and ions, that is to say homogeneously with plasma components, in the region of the reactor chamber outlet RA.

Figure 5:
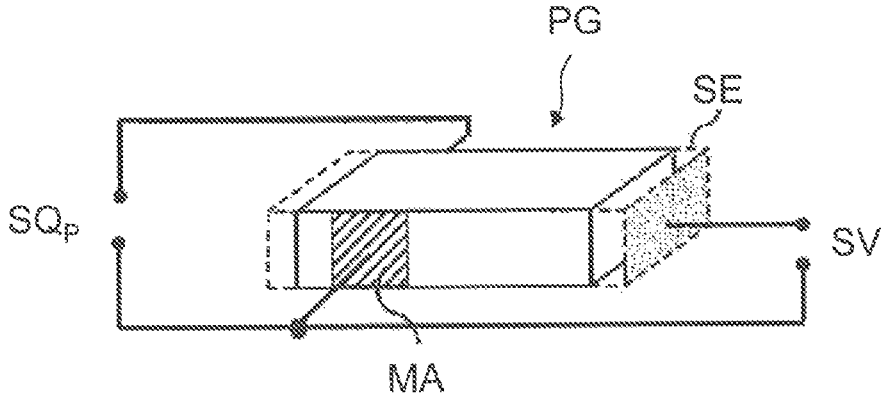
FIG. 5 shows a schematic view of a piezoelectric transformer which can be used for the invention.

FIG. 5 shows a schematic illustration of the structure of a piezoelectric transformer which can be used as a plasma generator PG. Said transformer is, for example, in the shape of an elongate right-angled parallelepiped, that is to say has a rod-shaped structure. On the primary side illustrated on the left in the figure, that is to say the low-voltage side, the right-angled parallelepiped has a multi-layer structure MA in which in which electrode layers, preferably made of copper, alternate with piezoelectric layers, preferably made of PZT ceramic. The multi-layer structure MA in its entirety is connected to a low-voltage source $SQ_p$ which connects the electrode layers alternately to an AC low voltage.

The secondary side, that is to say the high-voltage side of the piezoelectric transformer, extends approximately over the half ceramic transformer body and does not have any inner electrode layers. The secondary side comprises a single piezoelectric piezoelement whose electrodes are arranged on the end sides, that is to say at the ends of the rod transverse to the plane of the layers. The secondary voltage SV is then applied between an electrode of the primary side and an end face electrode SE.

A secondary electrode SE is made to extend on the high-voltage side near to or as far as the surface of the ceramic base body, with the result that a discharge can take place there. In FIG. 5 this is the right-hand end face or one of the edges of the right-hand end face. The electrode is made to extend to the surface in such a way that the high-voltage discharge can take place selectively at individual points, with the result that the energy thereof is concentrated there and the plasma generation is improved, or that the plasma yield can be maximized. Alternatively, the end face on the outlet side can also be of convex design or the corners and edges can be rounded in order to ignite the plasma over a relatively wide exit area.

The electric actuation unit SP of the piezoelectric transformer comprises a HF source whose signal is applied to the primary side on the electrodes. The actuation unit SP also comprises a voltage regulator by means of which the power of the plasma generator PG can be set. Furthermore, the electrical actuation unit SP can comprise at least parts of the control apparatus SE or can comprise the latter completely.

With the device according to the invention it is possible to generate free radicals and ions in a reactor chamber separately from the combustion chamber by ionizing at least one component of the fuel/air mixture at corners and edges at the end face of the high-voltage side of the piezoelectric transformer. With the device it is possible to introduce a controlled quantity of free radicals into the combustion chamber.

Setting the quantity of free radicals and ions is achieved by means of regulated mixing. A first component K1 is here the component which flows through the reactor chamber. The other component is the residue, in particular the fuel, which is absent from the total fuel/air mixture. However, the other component can also comprise a fuel/air mixture. It is also possible for the quantity of free radicals and ions in the combustion chamber to be controlled solely by means of the power of the plasma generator.

The fact that the reactor chamber RR is separated from the combustion chamber BR is actually what permits a piezoelectric transformer to be used to generate the high voltage for the plasma generator. Valves, throttles and openings for the regulated supply of gas components or fuel/air mixture components are provided on the feedlines for the components and/or at the reactor chamber inlet RE.

With the optional fan, which is preferably provided at the input of the reactor chamber, good mixing of the mixture component flowing through the reactor chamber is possible. The provision of the plasma generator in the reactor chamber is more cost-effective and can be configured with less technical complexity than the arrangement of a plasma generator in the combustion chamber which is already known in the prior art.

According to the invention, a high-temperature-resistant solution is not necessary for the plasma generator and the reactor chamber since high temperatures can occur only in the combustion chamber. The plasma generator can also be used with a low voltage supply of, for example, 12 V and a low power. Therefore, no high-voltage lines and/or high voltage plugs are necessary for the device according to the invention.

Various possible ways of easily regulating the required quantity of free radicals are specified depending on the embodiment.

The invention has been illustrated only on the basis of a small number of exemplary embodiments but is not restricted thereto. In particular, the embodiments illustrated in the figures do not specify any prescriptions with respect to the precise configuration of the device. The configuration of the device and the execution of the method are defined exclusively by means of the claims and can be modified within the scope thereof. Combinations and secondary combinations of features are also considered to be in accordance with the invention insofar as they are novel, even they are not present in the combination given by the claims.

The invention claimed is:

1. A device for burning a fuel/air mixture comprising:

a combustion chamber including at least one combustion chamber inlet for feeding in fuel or air or the fuel/air mixture;

a reactor chamber connected upstream of the combustion chamber, the reactor chamber comprising a plasma generator, wherein the plasma generator is a piezoelectric transformer configured to operate with a low voltage; and a control apparatus for the plasma generator, wherein the control apparatus is configured to adjust a frequency of the low voltage applied to the piezoelectric transformer and to adapt the frequency to a resonance and an impedance of the piezoelectric transformer, and wherein the device is configured in such a way that even before a start of an actual combustion process at least one gaseous component in the reactor chamber is enriched with radicals and ions by the plasma generator and is subsequently transferred into the combustion chamber via the combustion chamber inlet for actual combustion.

2. The device according to claim 1, wherein the combustion chamber is part of a combustion engine.

3. The device according to claim 1, wherein the combustion chamber comprises a combustion chamber outlet, wherein the control apparatus comprises a sensor arranged on or behind the combustion chamber outlet and a feedback loop, wherein the sensor is configured to acquire a value which constitutes a measure of a completeness of the combustion, and wherein the control apparatus is configured to regulate a power of the plasma generator by the feedback loop as a function of the value determined by the sensor in order to optimize the combustion.

4. The device according to claim 1, further comprising a gas/ion sensor for acquiring a concentration of the radicals and ions in the gaseous component or components, wherein the gas/ion sensor is arranged in front of the combustion chamber inlet and is connected to the control apparatus.

5. The device according to claim 1, wherein the reactor chamber and the combustion chamber inlet are equipped with an inert surface or have a coating made of an inert material.

6. The device as claimed in claim 5, further comprising a fan near a reactor chamber inlet which is designed to mix the gas component in the reactor chamber.

7. The device as claimed in claim 1, wherein a first partial flow and a second partial flow for generating the fuel/air mixture are generated and introduced into the combustion chamber, wherein the radicals and ions are generated with the plasma generator only in the first partial flow of the fuel/air mixture in the reactor chamber, wherein the first partial flow is fed through the reactor chamber, and in contrast the second partial flow is not fed through the reactor chamber, and wherein the control apparatus regulates a concentration of the radicals in the entire fuel/air mixture which is introduced into the combustion chamber via the combustion chamber inlet, by varying a composition of the fuel/air mixture from the first and second partial flows.

8. A method for improving a combustion of a fuel/air mixture in a combustion chamber of a combustion engine or of a boiler in which the fuel/air mixture or one of its components is enriched with radicals and ions before being introduced into the combustion chamber by a plasma generator which is embodied as a piezoelectric transformer which is operable with a low voltage, and wherein a control apparatus is configured to adjust a frequency of the low voltage applied to the piezoelectric transformer and to adapt the frequency to a resonance and an impedance of the piezoelectric transformer, the method comprising:

determining a completeness of the combustion in the combustion chamber by the control apparatus and a sensor; and adapting a concentration of the radicals and ions as a function of a value acquired by the sensor in order to improve the completeness of the combustion.

9. The method according to claim 8, wherein a the plasma generator is varied in order to adapt the concentration of the radicals and ions.

10. The method according to claim 8, wherein the entire quantity of gaseous components introduced into the combustion chamber is composed of two partial flows, wherein the radicals and ions are generated with the plasma generator only in a first partial flow of the fuel/air mixture in a reactor chamber, and wherein a corresponding portion of the first partial flow in a total quantity of the fuel/air mixture is adjusted and regulated in order to adapt the concentration of the radicals and ions.

11. The method according to claim 8, wherein the piezoelectric transformer comprises a high-voltage side, and wherein a plasma is ignited at a surface of the high-voltage side of the piezoelectric transformer.

12. A device for burning a fuel/air mixture comprising:

a combustion chamber including at least one combustion chamber inlet for feeding in fuel or air or the fuel/air mixture;

a reactor chamber connected upstream of the combustion chamber and having a plasma generator, wherein the plasma generator is a piezoelectric transformer which is configured to operate with a low voltage, wherein the piezoelectric transformer comprises a high-voltage side, and wherein a plasma is ignitable at a surface of the high-voltage side of the piezoelectric transformer; and a control apparatus for the plasma generator, wherein the control apparatus is configured to adjust a frequency of the low voltage applied to the piezoelectric transformer and to adapt the frequency to a resonance and an impedance of the piezoelectric transformer, and wherein the device is configured in such a way that even before a start of the actual combustion process at least one gaseous component in the reactor chamber is enriched with radicals and ions by the plasma generator and is subsequently transferred into the combustion chamber via the combustion chamber inlet for actual combustion.

* * * * *